United States Patent [19]

Jidell

[11] Patent Number: 4,758,148

[45] Date of Patent: Jul. 19, 1988

[54] MANUFACTURE OF CONCRETE TILES

[75] Inventor: Karl B. Jidell, Nyköping, Sweden

[73] Assignee: ABECE Aktiebolag, Enstaberga, Sweden

[21] Appl. No.: 458,014

[22] Filed: Jan. 14, 1983

Related U.S. Application Data

[63] Continuation of Ser. No. 238,451, Feb. 26, 1981, abandoned.

[30] Foreign Application Priority Data

Feb. 29, 1980 [SE] Sweden ..... 8001614

[51] Int. Cl.[4] ..... B28B 3/12; B28B 5/02; B28B 11/14

[52] U.S. Cl. ..... 425/219; 198/804; 198/811; 425/114; 425/127; 425/220; 425/254; 425/315; 425/362; 425/373; 425/452; 425/453; 425/126.1

[58] Field of Search ..... 425/88, 112, 254, 255, 425/289, 470, 114, 126 R, 127, 219, 220, 315, 362, 373, 452, 453; 198/804, 811

[56] References Cited

U.S. PATENT DOCUMENTS 3,631,574 1/1972 Chapman ..... 425/470

*Primary Examiner*—Jan H. Silbaugh
*Assistant Examiner*—Leo B. Tentoni
*Attorney, Agent, or Firm*—Fred Philpitt

[57] ABSTRACT

In manufacturing concrete tiles a stiff concrete mass is molded and heavily compacted by means of a rapidly rotating pressing roller on sheet metal molding trays, which during the molding operation are supported by carriers having relief-like supporting surfaces which are generally complementary to the bottom sides of the tiles. The tray carriers form parts of an endless conveyor passing a concrete extruding station, in which the pressing roller is included, the tray carriers being formed as platforms placed freely between a pair of driving chains, to which each platform is connected by one pair of coaxial pivots only. Each platform is composed of two segments, which are hingedly interconnected independently of the chains. When passing the concrete extruding station the tray carrying platforms rest on an endless intermediate belt moving over a stationary supporting bed, through the top side of which pressurized air is supplied in order to reduce the friction. The sheet metal trays are delivered to and removed from the conveyor platforms by means of loop-forming, flexible elements.

6 Claims, 5 Drawing Sheets

MANUFACTURE OF CONCRETE TILES

This a continuation of application Ser. No. 238,451, filed Feb. 26, 1981 now abandoned and the benefits of 35 USC 120 are claimed relative to it.

BACKGROUND OF THE INVENTION

The present invention relates to the manufacture of generally rectangular concrete tiles having a top side (in the manufacturing process proper) the configuration of which is defined by rectilinear motion of a selected surface generatrix between two opposite edges of the tile, and a bottom side (likewise in the manufacturing process proper) the configuration of which differs from that of the top side at least as a result of a thickness variation of the tile in the direction of motion of the generatrix of the top side thereof.

A typical example of a concrete product of this kind is a roofing tile, the top side of which is most frequently either single- or double-cupped, and the bottom side of which follows the cross sectional contour of the top side in part but at certain places along its length is formed with transversally extending ridges and frequently also with local knobs. However, there are also many other types of concrete products presenting fairly similar manufacturing problems and among them certain types of wall facing tiles, covering slabs, etcetera may be mentioned.

More specifically the invention is concerned with a process and a machine for manufacturing in large series concrete tiles of the kind defined hereinbefore, in which portions of a still but yet plastic concrete mass are deposited under heavy compaction on separate molding trays each having a bearing surface which is complementary to the bottom side of the tile to be formed, the compaction being carried out by placing each tray in a predetermined position on a movable tray carrier and passing the latter with the tray thereon under a rotating pressing roller, the circumferential surface of which has a generatrix which is complementary to the suface generatrix of the top sides of the tiles, and in which each concrete mass portion thus molded and compacted is retained on its related tray until having reached a self-supporting state in which it may be readily handled without the support of the molding tray.

It is well known that by using such a process a considerable number of identical concrete tiles may be molded per hour, but also that, so far, no appreciable reduction of the manufacturing cost per product unit has been reached in comparison with the cost for manufacturing the tiles much more slowly by using more primitive mechanical equipments and a considerably higher amount of manual work. The reason for this is the very great investment which in the case of mass production has to be made in the molding trays which have to follow the tiles from the time, when they are molded, and all up to the time, when the concrete mass has hardened sufficiently to make the products capable of resisting all such strains to which they will be subjected during their continued handling in the factory as well as during their transportation to possible retailers or directly to consumers.

During decades various attempt have been made to shorten the time in which the molded concrete mass needs to remain on the molding trays, but with few exceptions the success of such attempts has been doubtful. Nowadays it is common practice, however, to accelerate the hardening of the molded concrete products in special chambers, in which favorable temperature and moisture conditions are maintained artificially, and such a measure is preferably used also in combination with the present invention, but neither in this way any substantial reduction of the manufacturing costs has been achieved, when the production capacity of the plant is, for example, several thousands of units during the period of time corresponding to the circulation time of the individual molding trays.

On the other hand, the tiles manufactured according to the process defined hereinbefore are, no doubt, of a much superior quality as compared with those produce in a more primitive way. In fact, their mechanical strength is considerably improved and, above all, their tendency to absorb moisture and to crack or burst in cold weather is appreciably reduced. This is a result of the heavy compaction of the concrete mass ensured by the rapidly rotating pressing roller which, in addition, by a kind of rubbing action condenses and seals the surface of the product engaged by the roller itself. It is to be noted, however, that the compacting forces exerted by the pressing roller also subject the molding trays and their carriers to severe strains, a pressure on the concrete mass, and hence, on the trays, of more than 100 MPa not being unusal.

The molding trays which have been used so far in the process defined hereinbefore were made of metal castings and, depending on the accuracy of the casting technique used, needed more or less extensive finishing work before they could be used. As a result, such molding trays were very expensive, but nevertheless trays of this kind were considered indispensable, because by the provision of stiffening fins or ridges on their lower sides they could easily be given the required strength to resist deformation under the considerable loads referred to above. However, the high unit price of these cast trays evidently results in heavily increased investment costs in a plant for the mass-production of the concrete tiles and thus counteracts the reduction of manufacturing cost gained by the high production rate. In addition, the necessary frequent replacement of the molding trays, which are subjected to a significant wear in use, causes considerable extra costs.

Now, a general object of this invention is to improve the economy in the mass-production of concrete tiles and similar concrete products according to the process defined hereinbefore.

With this object in view the invention is based on the understanding that the investment cost in a plant for mass-production of concrete tiles, and hence the cost per produced unit, could be drastically reduced by using a simplier and thus considerably cheaper kind of molding trays then the one described above, even if this would result in a certain but moderate cost increase as far as the machine equipment proper is concerned. Molding trays which would be excellent for such purpose are those made of sheet metal of only a moderate thickness not exceeding about 3 millimeters, because such sheet metal trays, when made in reasonably large series, may easily be given even farily complex surface configurations by deep drawing and/or local embossing and will be much less expensive than the cast trays referred to hereinbefore. Besides, such sheet metal trays have already been successfully used in certain older tile making processes and machines, in which only a moderate compacting of the concrete mass, such as by vibrating, was resorted to. A further advantage of sheet metal trays is that they may be made of stainless sheet steel, which will make them fairly resistant to both wear and corrosion.

However, the problem with such sheet metal molding trays is that, unless special measures are taken, they will not be able to take up the heavy deforming loads deriving from the pressing roller used for compacting the stiff concrete mass on the trays in modern tile molding processes and machines of the kind referred to hereinbefore. In fact, the sheet metal trays, when used in a conventional manner, will at least resiliently yield and frequently give away and become permanently deformed under such loads, which, of course, is entirely unacceptable.

SUMMARY OF THE INVENTION

According to the present invention the problem referred to above is basically solved by resting the sheet metal trays, at least when passing them under the compacting pressing roller, on carriers presenting relief-like supporting surfaces which are at least generally complementary to the lower sides of the trays, thereby preventing any deformation of the trays under the influence of the heavy compacting forces exerted by the pressing roller.

The invention is also concerned with a machine for carrying this new concept into effect and for thus molding concrete tiles on individual molding trays, the bearing surfaces of which are complementary to the bottom sides of the tiles to be produced, the machine being of the kind comprising an endless conveyor for moving the molding trays in close succession and including a plurality of inter-connected tray carriers adapted to carry one molding tray each in a given position; a supporting bed, along and over which the tray carriers of the conveyor are moved; a concrete extruding station mounted above the supporting bed for depositing a stiff concrete mass in a continuous layer on the molding trays moved by the conveyor; and a device for severing the concrete mass layer thus deposited on the molding trays into lengths corresponding to the trays; and in which the concrete extruding station includes a rapidly rotating pressing roller for heavily compacting the concrete mass as the same is deposited on the passing molding trays.

According to the invention such a molding machine is mainly characterized in that each tray carrier of the conveyor has a relief-like tray supporting surface which, apart from certain surface interruptions representing only minor portions of its area, is generally complementary to the bottom sides of the tiles to be moulded and adapted to receive a molding tray made of sheet metal having a practically uniform thickness of at most 3 millimeters, whereby such fairly weak molding trays may be used in the machine without any danger of being deformed by the heavy concrete compacting forces exerted by the pressing roller of the concrete extruding station.

BRIEF DESCRIPTION OF THE DRAWINGS

For further elucidation of the invention a preferred example of a machine embodying the same and the operation thereof will now be described with reference to the accompanying drawings, in connection with which various other important features of the invention will appear. In the drawings.

DESCRIPTION OF THE PREFERRED EMBODIMENTS

Figure 1:
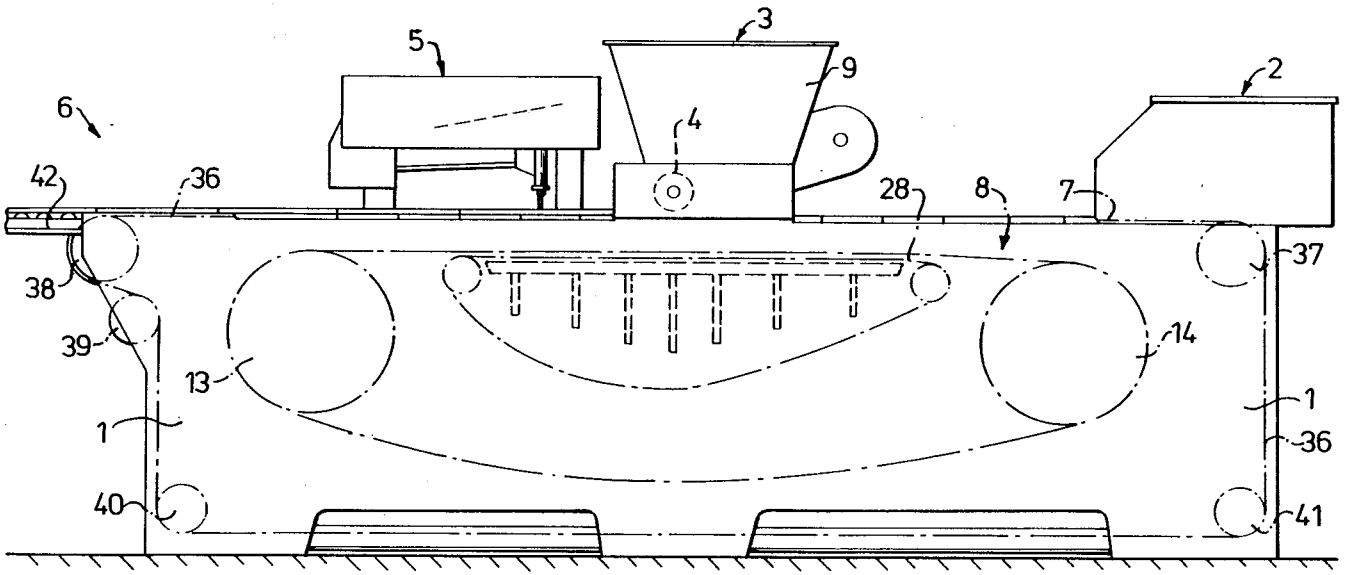
FIG. 1 is a diagrammatic sideview of the tile molding machine.

The molding machine shown in the drawings is intended to produce in large series and at a high rate a special type of generally rectangular concrete roofing tiles each having a top side, the configuration of which is defined by rectilinear motion of a wavy surface generatrix between the two opposite end edges of the tile, and a bottom side, the configuration of which by the presence of various knobs and transverse ridges or fins differs from that of the top side. More specifically, the machine is of the general kind, in which the tiles are molded on individual molding trays defining the bottom side configuration of the tiles, whereas the top side configuration thereof is defined by a rapidly rotating pressing roller exerting heavy compacting forces on the concrete mass deposited on the molding trays, the roller having a circumferential surface, the generatrix of which is complementary to the surface generatrix of the top side of the tiles to be produced. As usual the molding trays are utilized as supports for the molded tiles all up to the point of time when the concrete mass has hardened sufficiently to permit handling of the tiles separately with no considerable danger of cracking or breaking them.

It is to be noted that, when reference is here made to the top side and the bottom side, respectively, of the tile, this solely relates to the position of the tile in the tile molding process and not to a possibly normal position of the product in its later use.

As appears from FIG. 1 the molding machine shown comprises a frame structure 1 supporting a feeding-in station 2 at its inlet end portion to the right in the figure, a concrete extruding station 3 including a rotatable pressing roller 4, and a severing device 5, the frame structure having an outlet end portion 6 to the left. At the feeding-in station 2 molding trays 10 of a nature to be described later on are supplied to the machine in order to then pass the latter in a direction towards the outlet end portion 6. In the feeding-in station 2 the molding trays, which in advance have been carefully cleaned, may be provided with a coating of a suitable release agent, such as oil, in order to prevent the tile-forming concrete mass from adhering. From the feeding-in station 2 the molding trays 10 are transferred one by one in close end to end succession by means of an auxiliary conveyor 7 to a main conveyor 8 which carries the molding trays during their passage under the concrete extruding station 3 and the severing device 5 following thereafter.

In the concrete extruding station 3 a stiff concrete mass from a vibrated hopper 9 is deposited on each and all of the passing molding trays 10 in the form of a continuous layer. The deposition of the concrete mass on the passing trays is effected by the rapidly rotated pressing roller 4 which concurrently subjects the concrete to a heavy compaction. In order not to wear out to soon, the roller 4 has to be made of a highly wear-resistant material, such as a sintered carbide alloy. The continuous layer of heavily compacted concrete mass is then divided up by means of the severing device 5 in such manner that each molding tray will carry its own product-forming concrete mass portion, when it reaches the outlet end portion 6 of the machine.

It is to be pointed out that the feeding-in station 2, the concrete extruding station 3, and the severing device 5 may have the same general design and operate in generally the same manner as corresponding units in already known modern molding machines. This is true also as for as the plant is concerned, of which the molding machine forms a part and which usually further includes a hardening chamber for curing the molded concrete tiles on their trays as well as means for transferring the molding trays from the machine to the hardening chamber, means for removing the finished, hardened tiles from the trays and means for cleaning and returning the latter to the inlet station of the machine.

Figure 2:
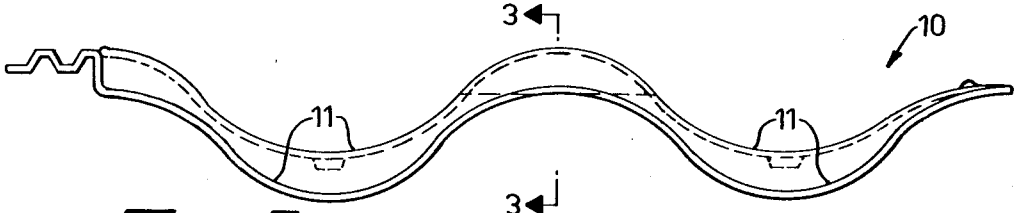
FIG. 2 shows on an enlarged scale an end view of a molding tray made of deep drawn and locally embossed sheet metal and intended to be used in the machine.
Figure 3:
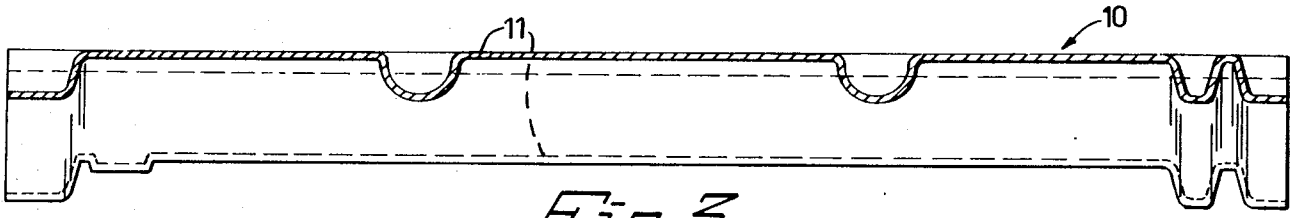
FIG. 3 is a longitudinal section of the same sheet metal tray taken along the line 3—3 in FIG. 2.
Figure 5:
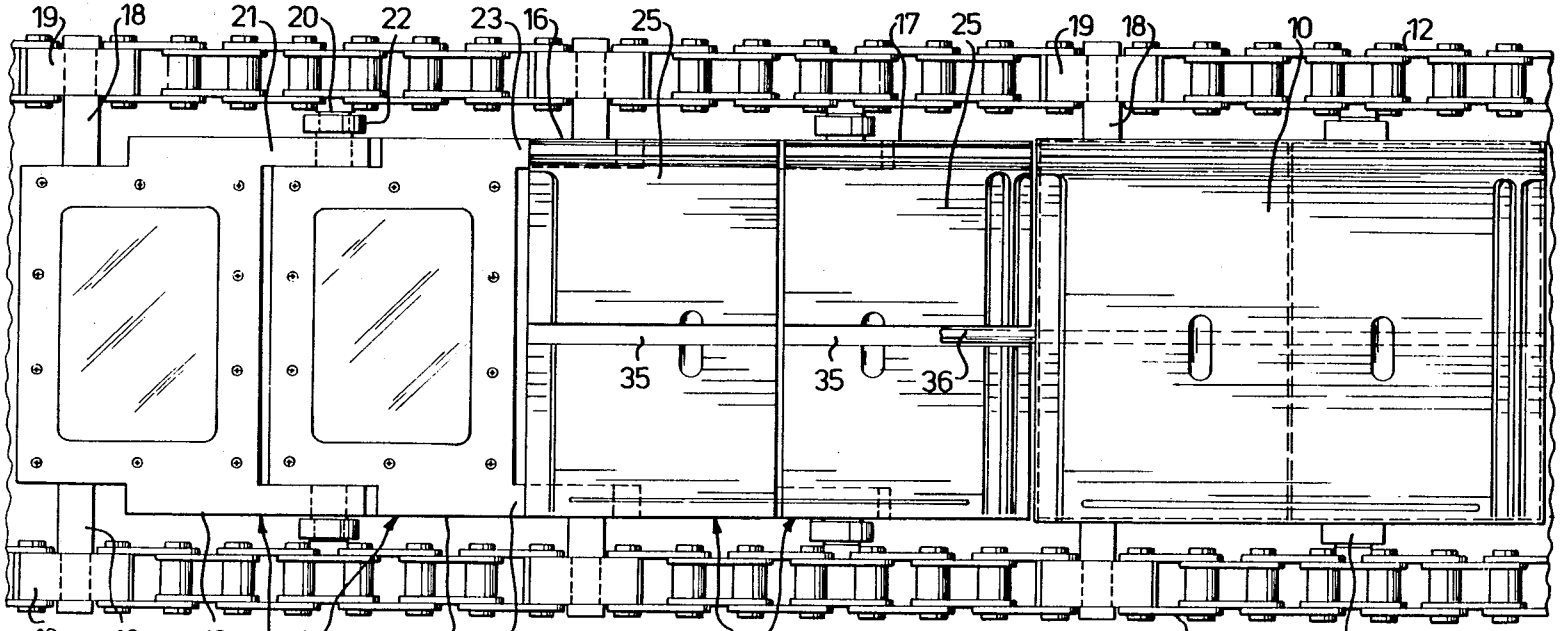
FIG. 5 is a plan view of a part of the conveyor of the machine where also the construction of the tray carrying platforms has been indicated.

An example of a molding tray to be used in the machine of FIG. 1, is shown in FIGS. 2 and 3. This tray 10 is made of sheet metal, preferably of stainless steel, having a uniform thickness of about 2 millimeters, which by deep drawing and local embossing carried out in a known manner has been imparted such a configuration that its upper side 11 serving as a bearing surface for the tile to be molded is complementary to the bottom side of the tile, it being understood that the lower side of the tray with only insignificant deviations follows the relief-like configuration of the upper side thereof. Obviously the deep drawing of the sheet metal results in a marked stiffening of the same, whereby the molding tray thus formed probably will show a sufficient shape permanence even if made of a considerably thinner sheet metal, say one having a thickness of only 1 millimeter, but the thickness of the sheet metal must be chosen to also give the molding tray a satisfactory resistance to wear. If desirable, the sheet metal tray may be provided with preferably downwardly bent marginal portions, for instance along its ends, its longitudinal sides or both (not shown).

As best appears from FIGS. 5 to 8 inclusive, the main conveyor 8 of the machine is composed of two synchronously operating, endless driving chains 12 which in spaced parallel relationship run over and between two pairs of coaxial sprockets 13 and 14, of which the one pair 13 is driven in a manner not shown, e.g. by an electric motor. Freely between the chains 12 there is placed a series of platforms 15 serving as carriers for the molding trays 10, when the latter are passed under the concrete extruding station 3, and each such platform 15 is composed of two hingedly interconnected segments 16, 17. Each platform 15 is driven by having its foremost segment 16 only connected to the two driving chains 12, and this connection is established by means of a pair of coaxial pivots 18 projecting on opposite sides of the segment 16 and having their outer ends journalled in special links 19 inserted in the two driving chains at uniform intervals generally corresponding to the length of the molding trays 10.

The two segments 16 and 17 of each platform 15 are interconnected by means of a pair of coaxial pins 20 projecting on opposite sides of the rear segment 17 and extending through and being journalled in rearwardly directed arms 21 on the front segment 16. Outside the arms 21 these pins 20 carry freely rotatable guiding rollers 22. Also the rear segment 17 of each platform 15 has a pair of rearwardly directed arms 23, one on each side, which between them receive the foremost portion of the front segment 16 of the next following platform and which by means of fork-shaped ends hingedly embrace the pivots 18 on the latter. In this manner also the rear portion of each platform will be guided, but it is to be noted that the connection between the rear ends of the arms 23 and the pivots 18 of the next following platform will transmit no driving power and, therefore, any elongations of the driving chains 12 will not change the mutual relationship between the segments 16 and 17 of the individual platforms but only the distance between the platforms following after each other.

From what has just been said it follows that the foremost and rearmost end portions of each platform 15 follow a path determined by the driving chains 12. On the other hand, the guiding rollers 22 may move independently of the chains by following suitably shaped, fixed guiding rails (not shown). In addition, as appears from the drawings, the segments of the platforms are so shaped that they can only be angularly displaced relative to each other in the direction, in which the driving chains 12 bend over the sprockets 13 and 14. Also, the pivots 18 as well as the pins 20 are placed a good distance behind the foremost edge of the related platform segment. All this contributes to a pattern of movement of the platform segments of the main conveyor 8 which ensures a trouble-free engagement between the platforms and the molding trays 10 at the inlet end of the machine as well as to an equally trouble-free disengagement of the molding trays from the platforms 15 at the outlet end of the machine, which is still more important because the molding trays are then carrying the newly molded and thus very fragile product-forming concrete mass portions.

As already mentioned, each molding tray 10 is carried by a related platform 15 as it is passed through the molding machine, and, as it is extremely important to prevent the thin and relatively weak sheet metal tray from being deformed when subjected to the very high concrete compacting force exerted by the pressing roller 4 of the concrete extruding station 3, the two segments 16 and 17 of each platform 15 are built up in such a manner that together they offer the sheet metal tray 10 resting thereon a relief-like supporting surface 25 which is at least generally complementary to the lower side of the tray and hence also to the bottom side of the tile to be molded thereon, and which with only negligible interruptions extends under practically the entire area of the sheet metal tray.

In the preferred example shown, the supporting surface 25 is formed in the upper side of a top layer 26 of rubber or some other elastically deformable material rested on and attached to an underlying rigid carrier member 27 of metal. The elastic top layer 26 contributes to a substantially uniform distribution of the supporting forces over the entire sheet metal tray 10 but it is to be noted that the thickness and elasticity of the top layer must be carefully selected to ensure that the position of the molding tray 10 relative to the carrier platform 15 is distinctly fixed in all directions especially during the passage under the pressing roller 4, because otherwise the uniformity of the molded tiles is hazarded and at the same time the acceptable size tolerances of the product are easily exceeded.

It should be clear that the sheet metal molding trays 10, even if they need a well distributed support for not being deformed under the extreme pressure exerted by the roller 4, always has a certain ability to bridge minor interruptions in the supporting surface 25 such as recesses, grooves or the like as well as the slot between the platform segments 16 and 17. In practice it is also preferred to let the outermost longitudinal marginal portions of the tray project a few millimeters outside the supporting surface 25, because this may facilitate the molding of the edges of the tiles and at the same time ensure that possible waste of concrete mass, which is highly abrasive, only exceptionally finds its way to the driving chains 12, the pivots 18, and the pins 20 with their guiding rollers 22.

Figure 4:
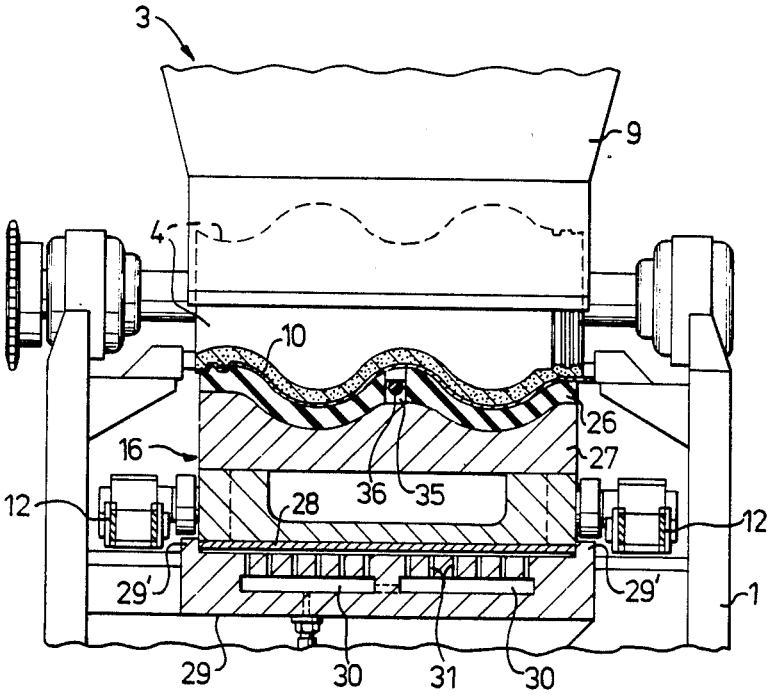
FIG. 4 is a somewhat simplified and only partial cross section of the machine illustrating its concrete extruding station seen from the left in FIG. 1 but on an enlarged scale.
Figure 6:
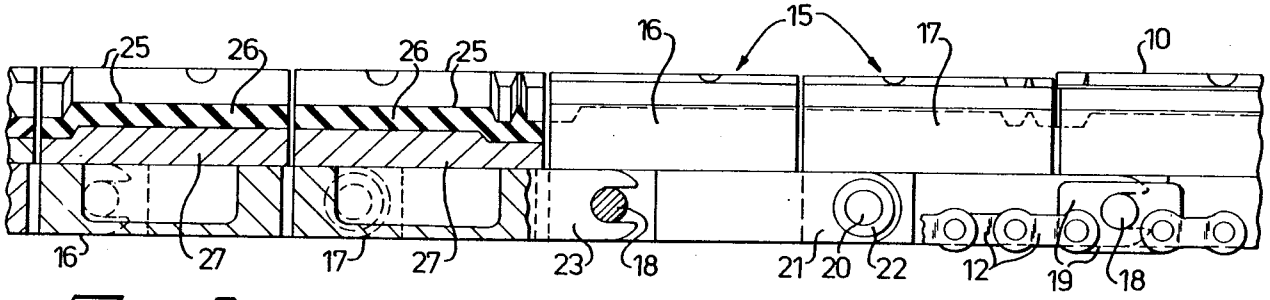
FIG. 6 is a combined side view and partial longitudinal section of the conveyor.
Figure 7:
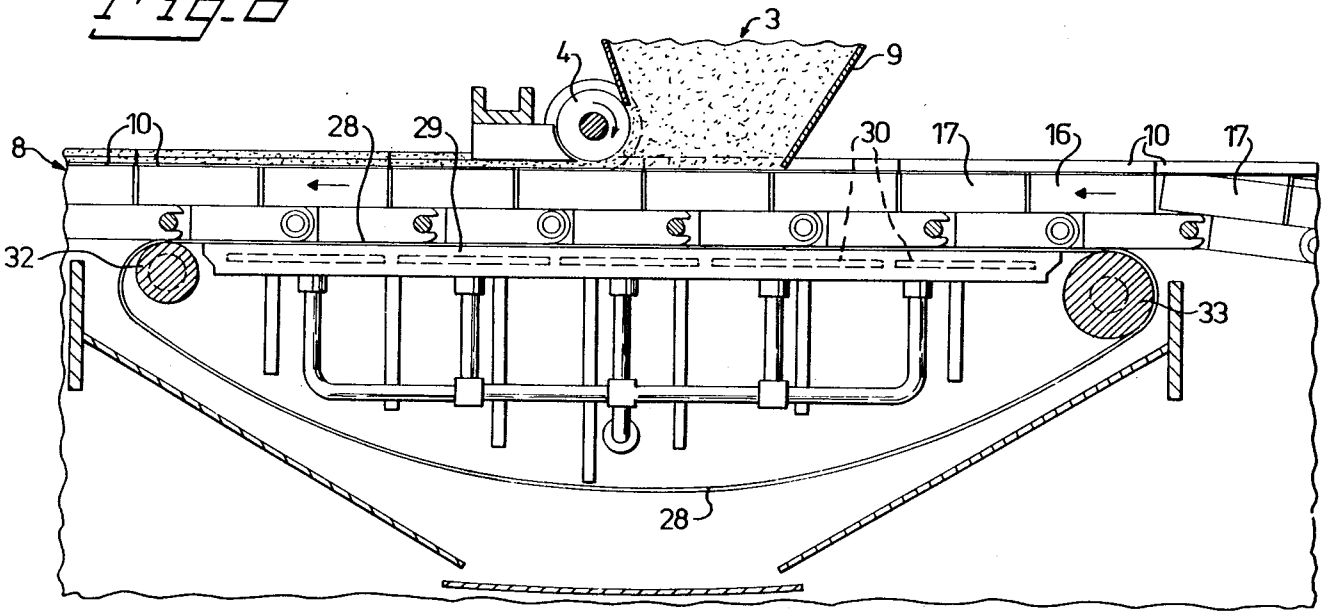
FIG. 7 is a partial and somewhat simplified longitudinal section through the machine illustrating the travel of the machine conveyor over a supporting bed during its passage under the concrete extruding station.
Figure 8:
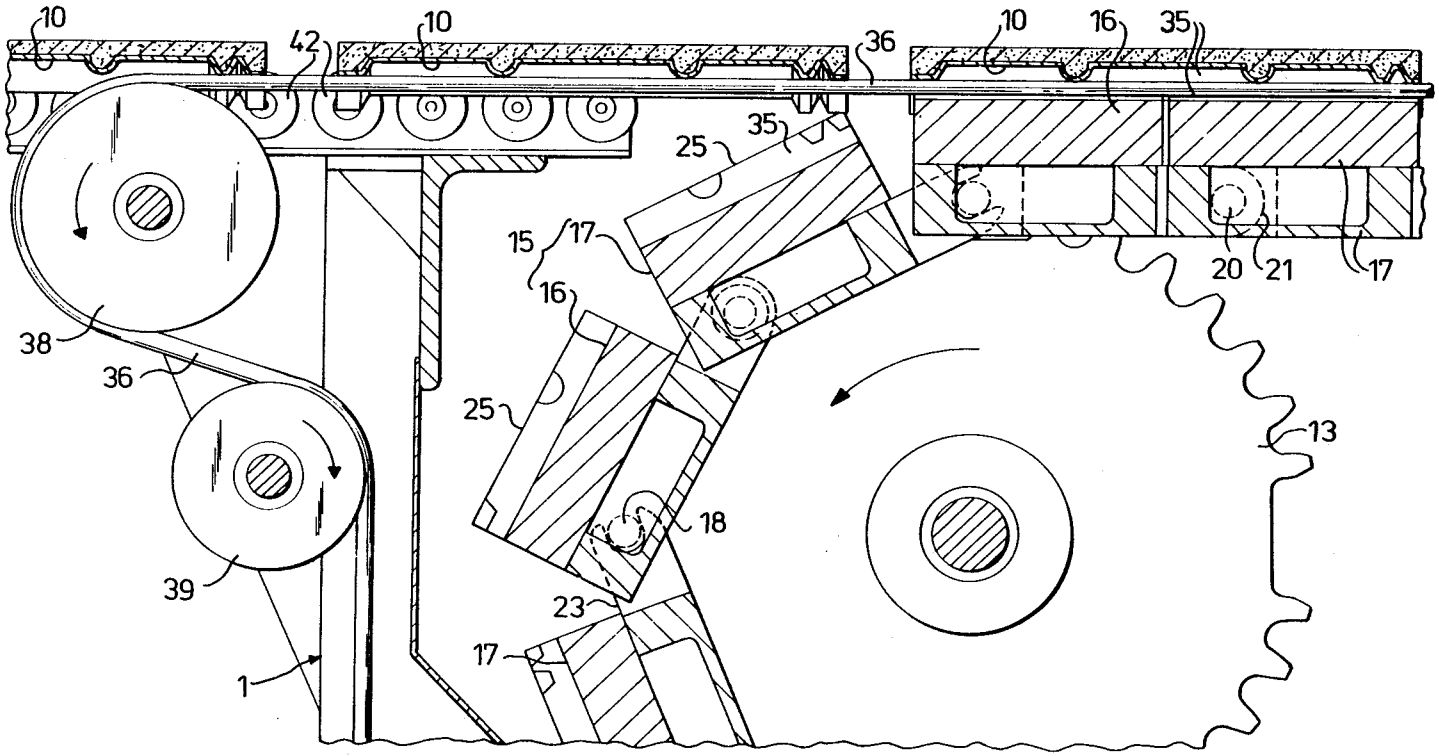
FIG. 8 is a likewise somewhat diagrammatical and only partial longitudinal section illustrating the removal of the molding trays from the machine conveyor at the outlet end portion of the machine.

In order to ensure that the platforms 15 do not rock, jump or otherwise move irregularly when passing under the pressing roller 4 of the concrete extruding station 3, which could have a detrimental effect on the produced tiles, the platform segments 16, 17 when moving along this portion of their path are rested with their bottom sides in spread-out contact with an endless intermediate belt 28, which is movable over a stationary supporting bed 29 formed with cavities 30, to which pressurized air is supplied in a manner not shown. From the cavities 30 the air is distributed through a plurality of apertures 31 (FIG. 4) and introduced between the top surface of the supporting bed 29 and the bottom side of the intermediate belt 28 so that the latter will come to rest on and move over a kind of air cushion with a minimum of friction. Along its longitudinal side edges the supporting bed 29 is provided with raised borders 29' for laterally guiding the intermediate belt 28 which is indirectly driven by the platforms 15 and at the respective ends of the supporting bed 29 runs over pulley rollers 32 and 33, respectively. When being returned, the belt 28 may pass a cleaning device, not shown, in order to be freed from possible waste of concrete mass. It is to be noted that the supporting bed 29 extends only from a point just before the concrete extruding station 3 and to a point shortly after the severing device 5 and that the intermediate belt 28 during its return movement is entirely separated from the platforms 15.

Approximately midway between their lateral edges, which coincide with the direction of advance of the conveyor 8, the supporting surfaces 25 of the platform segment 16, 17 are formed with a groove or channel-like recess 35. These grooves are aligned in the various platforms 15 and serve to receive the upper part of a rope 36 which with advantage may be somewhat elastically extensible and which forms an endless loop running over pulleys 37, 38, 39, 40 and 41 (FIG. 1), of which, if so desired, one may be driven for in its turn to drive the rope with a velocity which is just a little higher than that of the main conveyor. The pulley 37 is arranged at the inlet end of the machine under the feeding-in station 2 in order to cause the rope 36, when moving along a first portion of its path, to form the auxiliary conveyor 7 and thus contribute to the feeding forward of the molding trays 10 to the main conveyor 8, whereas the pulleys 38 is arranged at the outlet end of the machine in order to cause the rope 36 at this place to serve as a tray removing element and to support the molding trays when they are transferred from the platforms 15 of the main conveyor 8 to a roller way 42, from which the trays 10 with their related, molded concrete mass portions are then forwarded into a hardening chamber.

During the passage of the platforms 15 under the concrete extruding station 3 and the severing device 5, the rope 36, which suitably may be formed by a plastic hose, but which, if desired, may be substituted by a chain or some other flexible element, runs inoperatively beneath the molding trays 10 resting on the supporting surfaces 25 of the platforms 15 as a result of its natural deflection between the pulleys 37 and 38 and thus does not prevent a full contact between the molding trays and the related supporting surfaces of the platforms during the critical stage when the concrete mass is molded into the desired products. On the other hand the rope has a driving effect on the molding trays 10 within the outlet end portion as well as the inlet end portion of the machine and at the same time it assists within the last mentioned portion of the machine in releasing the molding trays from the relief-like supporting surfaces 25 of the platforms 15 when the platform segments 16 and 17 one by one deflect in a downward direction over the sprockets 13.

Of course, the illustrated use of one single, approximately centrally running rope 36 only requires that the molding trays 10 covered by concrete mass are additionally supported along their longitudinal marginal portions by sliding rails or roller ways, not shown, as soon as they start separating from the supporting surfaces 25 of the platforms 15. If such additional supporting means are undesirable, double, parallelly running ropes may be used instead for lifting away, in collaboration, the molding trays from the platforms 15 of the main conveyor 8 and for transferring them to the roller way 42, and in such a case the two ropes should run with a certain distance between them in order to cooperate with suitably selected portions of the lower sides of the molding trays. Of course, in the last mentioned case, also two rope receiving grooves or channels are required in the supporting surfaces 25 of the various platform segments 16, 17, one for each rope.

It should be clear that the machine herein described and shown may be modified in several other respecte without falling outside the scope of the accompanying claims.

I claim:

1. An apparatus for molding uniform concrete tiles, each having a top side, the configuration of which is defined by rectilinear motion of a selected surface generatrix between two opposite edges of the tile, and a bottom side, the configuration of which differs from that of the top side at least as a result of a thickness variation of the tile in the direction of motion of the generatrix of the top side thereof, said apparatus being of the kind comprising:

a horizontal supporting bed;

a plurality of uniform molding trays each having a tile bearing top side surface which is complementary to the bottom side of the tile to be molded and each having a length at least approximately corresponding to the lengths of the tiles to be molded;

an endless conveyor for moving said molding trays in close succession over and along said horizontal supporting bed;

means mounted above said horizontal supporting bed for depositing a stiff concrete mass in a continuous layer on the molding trays moved by said conveyor and including a rapidly rotating pressing roller for heavily compacting the concrete mass deposited on said trays; and means for severing the continuous concrete mass layer into lengths corresponding to the trays;

wherein (I) each of said molding trays comprises a sheet metal blank having a uniform thickness of at most about 3 millimeters and being shaped by pressing to present a lower side, the configuration of which is closely similar to that of the bottom side of the tile to be molded, and wherein (II) said conveyor comprises (A) a pair of separate but synchronously driven, endless driving chains extending in spaced parallel relationship along opposite sides of said horizontal supporting bed, and (B) a plurality of separate and mutually independent tray-carrying platforms placed between said two driving chains, each of said tray-carrying platforms (a) having a length closely corresponding to the length of each of said uniform molding trays, and (b) being connected to said driving chains by means of only one pair of coaxial pivots so as to be individually pulled over and along said horizontal supporting bed by said two chains, and (c) having a flat lower side adapted to rest on and in surface contact with said horizontal supporting bed when the tray-carrying platform is moved over the bed, and (d) having an upper side forming a seat for receiving one molding tray at a time in a predetermined position, in which the lower side of the molding tray is in extensive surface contact with the tray-carrying platform and hence effectively prevented from sagging under the pressure exerted by said mass compacting rapidly rotating pressing roller.

2. An apparatus as set forth in claim 1, wherein each tray-carrying platform is composed of at least two segments following after one another and being hingedly interconnected independently of said driving chains, only the foremost one of said platform segments being connected to said two driving chains by said one pair of coaxial pivots, and wherein means are provided to cause said platform segments to follow a path outside the ends of said supporting bed, which is nearly the same as, but not identical with, the paths followed by the two driving chains.

3. An apparatus as set forth in claim 1 wherein said horizontal supporting bed comprises an endless, movable belt, on which said tray-carrying platforms are rested with their flat lower sides in spread out surface contact, means being provided to support said belt in a manner to let it follow the platforms while moving in a straight line.

4. An apparatus as set forth in claim 3 wherein said horizontal supporting bed further comprises a stationary, flat surface, over which said belt is movable, and means for introducing and distributing pressurized air between said flat surface and the belt.

5. An apparatus as set forth in claim 1 wherein each of said tray-carrying platforms has at least one longitudinally extending groove in its tray supporting seat, the grooves in the various platforms being aligned, and wherein a tray removing element, which at least bridges a gap between the outlet end of the conveyor and a device for carrying away the molding trays with their superposed, tile-forming concrete mass portions, is received in said aligned platform grooves.

6. An apparatus as set forth in claim 5 wherein said tray removing element is a flexible element forming an endless loop running over pulleys and having an active part following said tray carrying platforms over said supporting bed.

* * * * *